US009133650B1

(12) United States Patent
Luca

(10) Patent No.: US 9,133,650 B1
(45) Date of Patent: Sep. 15, 2015

(54) DOOR CLOSING LATCHING MECHANISM

(76) Inventor: Valentin Luca, Fairfield, CT (US)

( * ) Notice: Subject to any disclaimer, the term of this patent is extended or adjusted under 35 U.S.C. 154(b) by 46 days.

(21) Appl. No.: 13/561,542

(22) Filed: Jul. 30, 2012

Related U.S. Application Data

(60) Provisional application No. 61/515,306, filed on Aug. 4, 2011.

(51) Int. Cl.
*E05C 1/12* (2006.01)
*E05B 63/20* (2006.01)

(52) U.S. Cl.
CPC ..... *E05B 63/20* (2013.01)

(58) Field of Classification Search
USPC ..... 292/165, 332–336
See application file for complete search history.

(56) References Cited

U.S. PATENT DOCUMENTS

| | | | | |
|---|---|---|---|---|
| 671,792 | A | 4/1901 | Comber | 292/2 |
| 3,322,451 | A | 5/1967 | Bredemus | |
| 4,572,556 | A * | 2/1986 | Foshee | 292/165 |
| 4,890,870 | A | 1/1990 | Miron | 292/333 |
| 5,560,079 | A | 10/1996 | Jeynes | 16/80 |
| 5,820,177 | A | 10/1998 | Moon | 292/335 |
| 6,327,881 | B1 | 12/2001 | Grundler et al. | 70/107 |
| 6,536,245 | B2 * | 3/2003 | Chiang | 70/107 |
| 6,578,888 | B1 | 6/2003 | Fayngersh et al. | 292/332 |
| 6,651,466 | B1 * | 11/2003 | Shih | 70/107 |
| 6,851,287 | B1 * | 2/2005 | Yang et al. | 70/107 |
| 7,007,985 | B2 | 3/2006 | Alexander et al. | 292/163 |
| 8,051,534 | B1 | 11/2011 | Luca | 16/667 |
| 2002/0101083 | A1 | 8/2002 | Toledano et al. | 292/332 |
| 2005/0092040 | A1 | 5/2005 | Chuang | 70/107 |
| 2006/0123859 | A1 | 6/2006 | Gonzalez | 70/107 |
| 2009/0033107 | A1 | 2/2009 | Zimmer et al. | 292/302 |
| 2009/0151407 | A1 | 6/2009 | Lin | 70/107 |

* cited by examiner

*Primary Examiner* — Mark Williams
(74) *Attorney, Agent, or Firm* — Fattibene and Fattibene LL; Paul A. Fattibene

(57) ABSTRACT

A door closing latch for securely latching a door having a closing trigger mechanism coupled to a latching or tongue mechanism. A latch or tongue upon contacting a strike plate on a door frame is pushed inward causing a connecting trigger mechanism to release a closing trigger forcing the door to completely close and latch. Turning a handle or door knob to open the door causes the latch or tongue to retract and the closing trigger mechanism to reset the closing trigger. A connecting trigger mechanism selectively decouples the turning of a door knob to prevent the latch from releasing the set closing trigger.

8 Claims, 4 Drawing Sheets

DOOR CLOSING LATCHING MECHANISM

RELATED APPLICATION

This application claims the benefit of U.S. Provisional Application No. 61/515,306 filed Aug. 4, 2011.

FIELD OF THE INVENTION

The present invention relates in general to a door closing mechanism and more particularly to a mechanism for assisting the complete closure and latching of a door.

BACKGROUND OF THE INVENTION

Pneumatic door closers often may not be adjusted properly to cause a door to close and latch completely. Often the door may close lightly with the latch resting on the jamb or strike plate on the frame of the door.

There are pneumatic door closers that are intended to provide improved door closing. One such pneumatic door closer is disclosed in U.S. Pat. No. 8,051,534 entitled "Pneumatic Door Closer" and issuing to Valentin Luca on Nov. 8, 2011. Therein disclosed is a pneumatic door closer that provides a controlled rate of closing motion that is generally uniform, smooth, and safe in moving from an open to a closed position. While these and other pneumatic door closers have improved the closing of a door, often the door does not completely close and latch. This may be due to inappropriate adjustment of the storm or screen door or too tight seals of the door.

Therefore, there is a need for a mechanism to assure that the door is latched when closed when there is insufficient force to close and latch a door.

SUMMARY OF THE INVENTION

The invention provides a closing trigger mechanism, connecting trigger mechanism, and latching or tongue mechanism that work together to close and latch a door. A closing trigger mechanism is set when a door knob is turned. Once set, the closing trigger mechanism is coupled to the latching or tongue mechanism by the connecting trigger mechanism. The connecting trigger mechanism is disabled by a cam when the door knob is turned to open the door retracting the latching or tongue mechanism. When the connecting trigger mechanism is engaged, a slight pressure on the latch causing movement of the latch or tongue inwards results in the connecting trigger mechanism to release the closing trigger forcing the door closed and to latch.

Accordingly it is an object of the present invention to latch a door securely.

It is another object of the present invention to prevent a door from being left partially open.

It is yet another object of the present invention to automatically assist a door to latch closed.

It is an advantage of the present invention that a door can be securely latched with little closing force or movement.

It is a feature of the present invention that a closing trigger is caused to release when a latch is moved inward.

It is another feature of the present invention that a contact is used to move a middle lever out of position disengaging the closing trigger mechanism from the latch so that the door can be opened without releasing or triggering the closing trigger.

These and other objects, advantages, and features will become more readily apparent in view of the following detailed ascription.

BRIEF DESCRIPTION OF THE PREFERRED EMBODIMENTS

Figures 1, 2, 3:
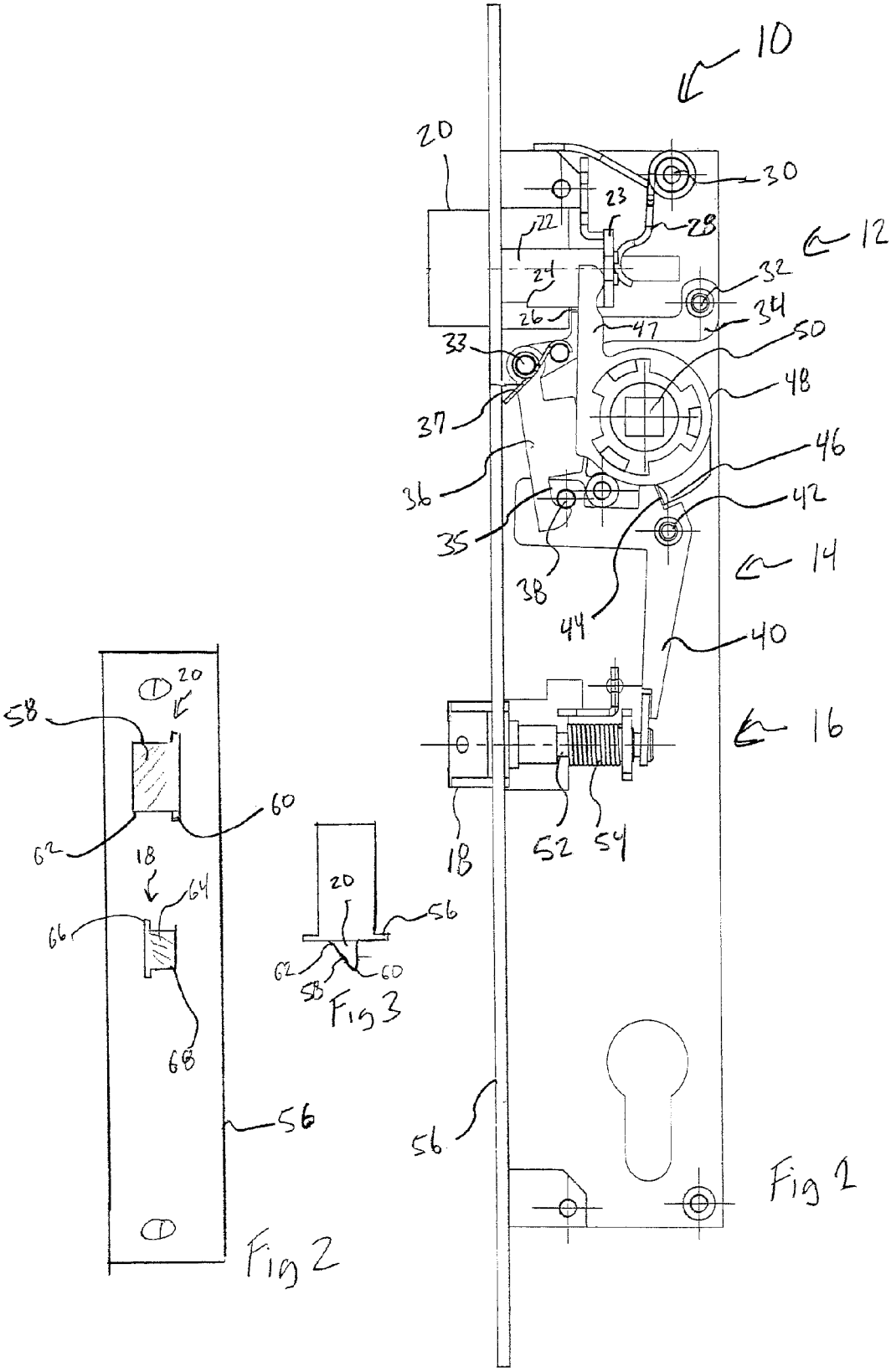
FIG. 1 schematically illustrates the latching mechanism of the present invention.
FIG. 2 is a front elevational view of a faceplate and latching mechanism illustrated in FIG. 1.
FIG. 3 is a top plan view of the latching mechanism illustrated in FIG. 1.
Figure 4:
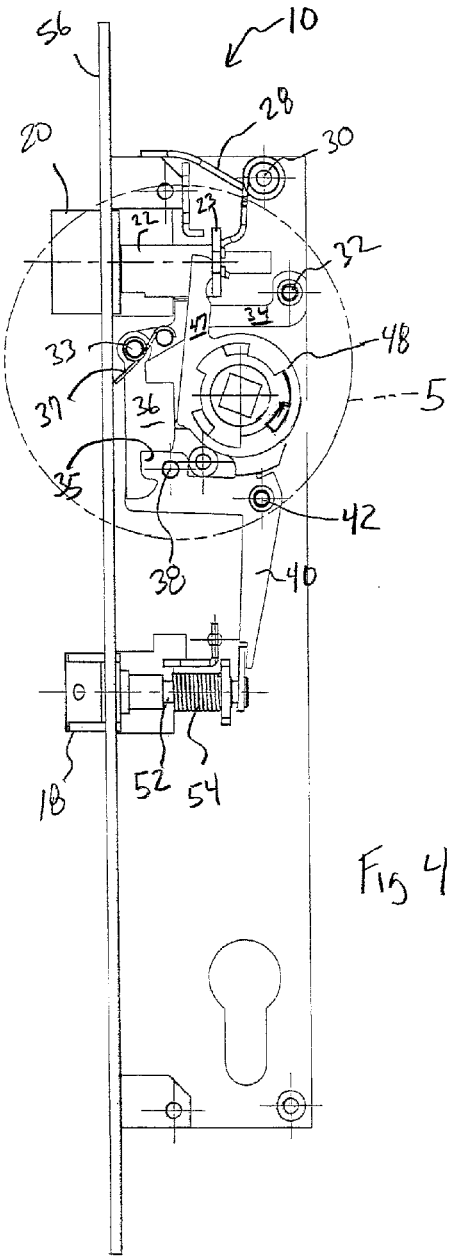
FIG. 4 illustrates the latching mechanism before setting of the closing trigger mechanism.
Figure 5:
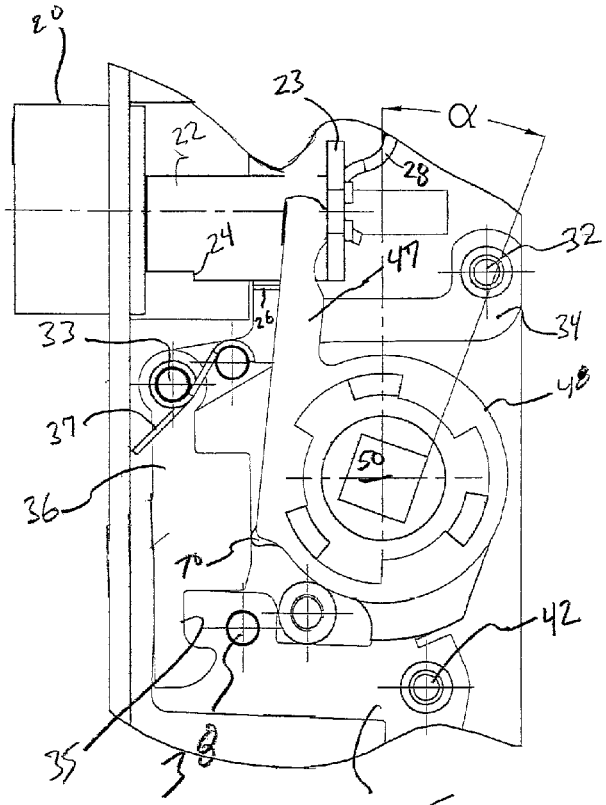
FIG. 5 illustrates the latching mechanism with the rotating handle plate or cam rotated clockwise approximately $\alpha$ degrees beginning the setting of the closing trigger and is an enlarged view taken from the phantom circle 5 illustrated in FIG. 4.
Figure 6:
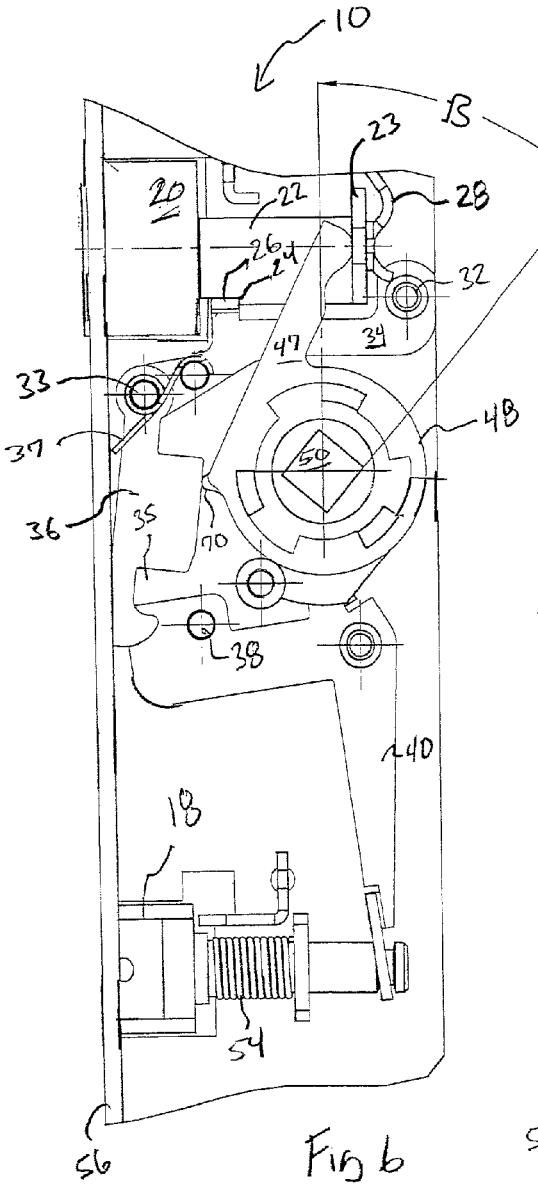
FIG. 6 illustrates the latching mechanism with the rotating handle plate or cam rotated further clockwise approximately $\beta$ degrees setting the closing trigger and retracting the latch or tongue, where $\beta$ is greater than $\alpha$.

FIG. 1 schematically illustrates the door closing latch 10 of the present invention. The door closing latch 10 comprises a closing trigger mechanism 12, a connecting trigger mechanism 14, and a latching or tongue mechanism 16. The closing trigger mechanism 12 operates to retract, set, and release the closing trigger 20. The connecting trigger mechanism 14 operates to selectively link the closing trigger mechanism 12 and the latching or tongue mechanism 16. The latching or tongue mechanism 16 retracts the latch or tongue 18 for releasing the door to be opened. The closing trigger mechanism 12, connecting trigger mechanism 14, and latching or tongue mechanism 16 operate when the rotating handle plate or cam 48 is rotated when a door knob or handle is inserted into square opening 50. The latch or tongue 18 of the door closing latch 10 retracts and sets the closing trigger 20 when the door knob, not shown, is rotated clockwise opening the door. When the door closes the latch or tongue 18, upon striking the jam or latch rail or plate of the door frame, not shown, will cause the release of the closing trigger 20 forcing the door, not shown, to be drawn in so as to fully close with the latch or tongue 18 latching into a strike plate in a jam or latch rail or plate, not shown. The latch or tongue 18 is normally biased out from the faceplate 56 by coiled helical spring 54.

The operation of the door closing latch 10 of the present invention can be readily appreciated referring to FIGS. 1-8. When a handle, not shown, placed within square opening 50 is turned, turning rotating handle plate or cam 48 clockwise the arm 47 contacts edge 23 on closing trigger slide 22 and pushes the edge 23 pulling the closing trigger 20 inward with attached closing trigger slide 22. Spring 28 on pivot 30 normally biases closing trigger 20 outward to extend beyond faceplate 56. The closing trigger 20 has a sloping surface 58 that slopes from a high point 60 to a low point 62. As the rotating handle plate or cam 48 is rotated a cam lobe 70, illustrated in FIG. 5, pushes middle lever 36 so that the pin 38 is released or disconnected from notch 35. The middle lever 36 is connected by pivot 33 to upper lever 34 which is connected to pivot 32. When the closing trigger 20 is fully retracted beyond the faceplate 56 the spring 37 is free to push catch 26 upward to contact shoulder 24 locking the closing trigger 20 in place in a retracted position. As the rotating handle plate or cam 48 is continued to be rotated clockwise contact 46 pushes on surface 44 causing the lower lever 40 to rotate counter clockwise about pivot 42 causing lower lever 40 to pull the attached tongue or latch rod 52 inward pulling the latch or tongue 18 inward flush to the faceplate 56 to unlatch the door. The latch or tongue 18 has a sloping surface 64 that slopes from a high point 66 to a low point 68. The direction of the sloping surface 64 of the latch or tongue 18 is opposite to that of the direction of the sloping surface 58 of the closing trigger 20. Therefore, the closing trigger 20 and the latch 18 have opposing inclined surfaces 58 and 64.

Figure 7:
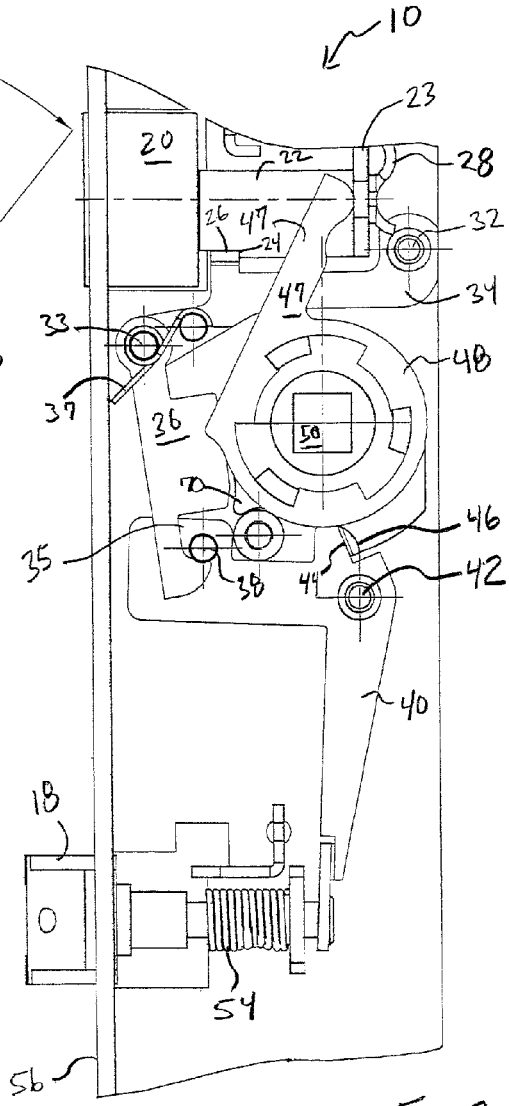
FIG. 7 illustrates the latching mechanism with the rotating handle plate or cam rotated counter clockwise back to a resting position with the closing trigger retracted or set.
Figure 8:
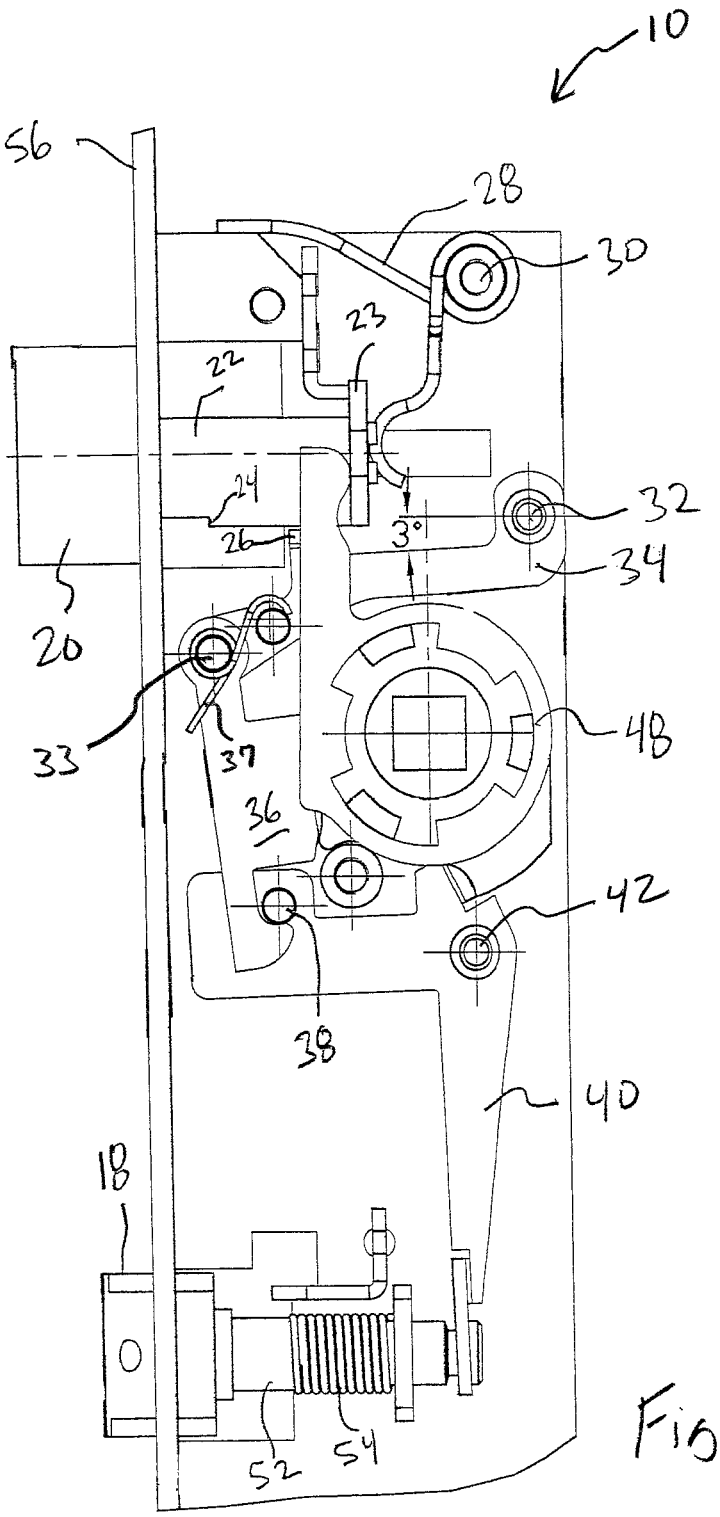
FIG. 8 illustrates the latching mechanism with a slight force on the latch or tongue causing movement and the closing trigger to be released forcing a door to close and latch.

When the door is closed, even if the door is gently closed so that there is insufficient initial door force or momentum to cause the latch to pass beyond the jamb or latch rail so as to engage a strike plate, the door closing latch 10 of the present invention assures latching of the door. When even a gentle force is applied to the latch or tongue 18 upon the closing of the door, the slight pressure on the latch or tongue 18 pushes it inward slightly. As best illustrated in FIGS. 7 and 8, when the latch or tongue 18 is pushed slightly inward, with the closing trigger 20 set or retracted, lower lever 40 is rotated counter clockwise on pivot 42 causing pin 38 placed within notch 35 to pull down on middle lever 36 causing catch 26 to release the shoulder 24 causing the closing trigger 20 to be released and move outward from the faceplate 56 due to the force of spring 28. The sloping surface of the closing trigger 20 contacting a strike plate, not shown, pulls the door completely closed permitting the latch or tongue to fully engage another strike plate, not shown, latching the door.

While the present invention has been described with respect to several embodiments, it should readily be appreciated that various modifications may be made without departing from the spirit and scope of this invention.

What is claimed is:

1. A door closing latch for pulling closed and latching a door, said door closing latch comprising:

a faceplate a rotating handle plate;

a closing trigger coupled to said rotating handle plate, said closing trigger having a sloping surface and adapted to be selectively retracted within and extended out of said faceplate;

setting means, coupled to said closing trigger, for setting said closing trigger in a retracted position;

a latch coupled to said setting means for setting said closing trigger; and decoupling means, couple to said rotating handle plate, for decoupling said latch from said closing trigger when a pressure is applied to said latch moving the latch inwards towards said faceplate, whereby said latch releases said closing trigger when said latch is moved inward without moving the rotating handle plate and the sloping surface of said closing trigger contacts a strike plate on a jam portion of a door frame forcing a door to close and latch.

2. A door closing latch for pulling closed and latching a door as in claim 1 wherein:

said setting means comprise, a shoulder formed on said closing trigger; and an upper lever having a catch adapted to mate with said shoulder.

3. A door closing latch for pulling closed and latching a door as in claim 2 wherein:

said decoupling means comprises, a middle lever pivotally coupled to said upper lever and coupled to said latch; and a cam lobe rotating with said rotating handle plate, said cam lobe positioned adjacent said middle lever, wherein when said rotating handle plate is rotated said cam lobe contacts a surface of said middle lever decoupling said middle lever from said latch.

4. A door closing latch for pulling closed and latching a door as in claim 1 further comprising:

an arm attached to said rotating handle plate and positioned to contact said closing trigger, whereby said closing trigger is pushed back and set when said arm is rotated by said rotating handle plate.

5. A door closing latch for pulling closed and latching a door as in claim 1 wherein:

said closing trigger and said latch have opposing inclined surfaces.

6. A door closing and latching mechanism for completely closing and latching a door automatically when the door may be slightly ajar, said door closing latch comprising:

a rotating handle plate;

an arm coupled to said rotating handle plate;

a closing trigger positioned adjacent said arm, whereby said arm pushes said closing trigger into a retracted position;

a shoulder formed on said closing trigger, said closing trigger having a sloping surface adapted to contact a strike plate on a jam portion of a door when the door is ajar;

an upper lever placed adjacent said closing trigger;

a catch placed on said upper lever positioned to mate with said shoulder, whereby said closing trigger can be held in a retracted position;

a middle lever pivotally attached to said upper lever;

a lower lever selectively coupled to said middle lever;

a cam lobe moving with said rotating handle plate and positioned adjacent said middle lever, wherein said cam lobe rides on a surface of said middle lever and moves said middle lever when said rotating handle plate is rotated causing said lower lever to be decoupled from said middle lever, whereby said upper lever and said catch are held in position adjacent said closing trigger; and a latch coupled to said lower lever, whereby when said lower lever is coupled to said middle lever and said latch is moved said closing trigger is released with the sloping surface of said closing trigger contacts the strike plate on the jam portion of the door forcing the door to completely close and latch, and when said rotating handle plate is turned a contact causes said middle lever to become decoupled from said lower lever preventing said closing trigger from releasing.

7. A door closing latch for pulling closed and latching an ajar door comprising:

a faceplate;

a closing trigger mechanism having a closing trigger with a first sloping surface adapted to selectively extend through said faceplate when released;

a latching mechanism having a latch with a second sloping surface adapted to selectively extend through said faceplate and latch a door closed, wherein the first and second sloping surfaces have opposing inclined sloping surfaces; and a connecting trigger mechanism coupled between said closing trigger mechanism and said latching mechanism, said connecting trigger mechanism releasing said closing trigger when a pressure is applied to the latch moving the latch inward, whereby the pressure applied to the latch of said latching mechanism causes said closing trigger mechanism to release the closing trigger and the first sloping surface to contact a strike plate on a door frame forcing a door to close and latch.

8. A door closing and latching mechanism for completely closing and latching a door automatically when the door may be slightly ajar comprising:

a faceplate;

a closing trigger having a first inclined surface;

means, coupled to said closing trigger, for setting and holding said closing trigger in a retracted position within said faceplate;

a latch having a second inclined surface extending from said faceplate, said second inclined surface having an opposing incline relative to the first inclined surface of said closing trigger, whereby when the door is closing a jam portion contacts the second inclined surface of said latch; and means, coupled to said latch, for releasing said closing trigger when said latch is pushed inwards causing said closing trigger to extend beyond said faceplate, whereby the first inclined surface of said closing trigger strikes a surface pulling the door completely closed permitting said latch to be fully engaged latching the door closed.

* * * * *